US006377151B1

(12) United States Patent
Takayama et al.

(10) Patent No.: US 6,377,151 B1
(45) Date of Patent: Apr. 23, 2002

(54) CHIP INDUCTOR AND METHOD OF MANUFACTURING SAME

(75) Inventors: Manabu Takayama; Makoto Saito, both of Tokyo (JP)

(73) Assignee: Taiyo Yuden Kabushiki Kaisha, Tokyo (JP)

( * ) Notice: Subject to any disclaimer, the term of this patent is extended or adjusted under 35 U.S.C. 154(b) by 940 days.

(21) Appl. No.: 08/917,288

(22) Filed: Aug. 25, 1997

Related U.S. Application Data

(63) Continuation of application No. 08/528,521, filed on Sep. 15, 1995, now abandoned.

(30) Foreign Application Priority Data

Sep. 19, 1994 (JP) ..... 6-223529

(51) Int. Cl.[7] ..... H01F 27/02; H01F 27/29
(52) U.S. Cl. ..... 336/83; 336/192; 336/206
(58) Field of Search ..... 336/83, 196, 206, 336/212

(56) References Cited

U.S. PATENT DOCUMENTS 1,994,534 A * 3/1935 Robinson ..... 336/83
4,549,042 A * 10/1985 Akiba et al. ..... 336/223
4,696,100 A * 9/1987 Yamomoto et al. ..... 336/192
4,801,912 A * 1/1989 McEleheny et al. ..... 336/83
4,842,352 A * 6/1989 Sasaki et al. ..... 336/83
5,359,311 A * 10/1994 Fawab et al. ..... 336/83
5,504,469 A * 4/1996 McGrone ..... 336/206

FOREIGN PATENT DOCUMENTS

JP 58-48410 3/1983
JP 59-151407 * 8/1984 ..... 336/192
JP 6-5427 1/1994

* cited by examiner

*Primary Examiner*—Anh Mai
(74) *Attorney, Agent, or Firm*—Armstrong, Westerman, Hattori, McLeland, & Naughton, LLP

(57) ABSTRACT

A chip inductor has a coiled conducting wire and a magnetic core which is formed by sintering and in which the coiled conducting wire is embedded. Both end portions of the coiled conducting wire are exposed to both end surfaces of the magnetic core in an arcuate or similar shape. External electrodes are coated on both the end surfaces of the magnetic core and are connected to both end portions of the coiled conducting wire.

8 Claims, 3 Drawing Sheets

CHIP INDUCTOR AND METHOD OF MANUFACTURING SAME

This application is a continuation of application Ser. No. 08/528,521 filed Sep. 15, 1995, now abandoned.

BACKGROUND OF THE INVENTION

1. Field of the Invention

The present invention relates to a chip inductor which uses a sintered magnetic core and also relates to a method of manufacturing the same.

2. Description of Related Art

Conventionally, there is known a method of manufacturing a chip inductor, characterized in that: a kneaded material to be obtained by kneading a powdered magnetic material (or magnetic substance) and a binder is pressurized to form it into a rectangular parallelepiped or a cylindrical body and thereafter sinter it to manufacture a bar of the magnetic material; a conductor (or a conducting wire) is wound around the bar of the magnetic material to thereby mount a coil in a coiled manner; terminals of the coil are extended to end surfaces of the bar of the magnetic material to thereby connect them to external terminals which are formed on the end surfaces of the bar of the magnetic material; the coil is then covered or coated with the kneaded material of the powdered magnetic material and the binder to thereby form an external cover (or coating); and thereafter a semimanufactured product thus obtained is sintered.

In the above-described chip inductor, the coil is covered with the magnetic material. Therefore, a circular magnetic circuit is formed in a manner to enclose the coil, with the result that an inductance value is high and that there is little or no magnetic field to leak outside the magnetic material. It has consequently an advantage in that, even if the chip inductor is disposed in close proximity to other parts, there will be no influence on the characteristics as an inductor and therefore that a density of mounting parts on a wiring circuit board or the like can be made higher.

However, this kind of inductor has a disadvantage in that, when a large pulse electric current is caused to flow therethrough, there is likely to occur a breaking at the connecting portions between the external electrodes and the terminal ends of the coil.

SUMMARY OF THE INVENTION

The present invention has an object of providing a chip inductor which is free from the above-described disadvantages and which is suitable for mass production, as well as providing a method of manufacturing the same.

In order to attain the above and other objects, the present invention provides a chip inductor comprising: coiled conducting wire means; a magnetic core which is formed by sintering and in which the coiled conducting wire means is embedded; wherein both end portions of the coiled conducting wire means are exposed to both end surfaces of the magnetic core in an arcuate or similar shape; and external electrodes which are coated on both the end surfaces of the magnetic core and which are connected to both end portions of the coiled conducting wire means.

Preferably, the coiled conducting wire means is made up of one or a plurality of bundled conducting wires. The one or a plurality of bundled conducting wires have a flattened cross section or an overall flattened cross section in the case of the plurality of conducting wires. The flattened cross section is arranged to lie along an axial line of the coiled conducting wire means.

According to another aspect of the present invention, there is provided a method of manufacturing a chip inductor comprising the steps of: forming a winding core by extruding a kneaded material which is obtained by kneading a powdered magnetic material and a binder; winding conducting wire means around the winding core in a coiled manner, a distance between adjoining winds being smaller than about twice the diameter of the conducting wire means; forming an external cover element to enclose the winding core around which the conducting wire means has been wound, the external cover element being formed by extruding the kneaded material; sintering the winding core and the external cover element; cutting a semimanufactured product obtained by the preceding steps into a predetermined length to thereby obtain a plurality of chip inductor main bodies, each of the chip inductor main bodies having on each of end surfaces thereof an arcuate or similar shape of exposed end of the conducting wire means; and forming an external electrode on each of the end surfaces of the respective said chip inductor main bodies to connect the external electrode to each of the exposed ends of the conducting wire means.

Preferably, the conducting wire means is made up of one or a plurality of bundled conducting wires whose cross section or an overall cross section in the case of the plurality of bundled conducting wires is flattened, the one or a plurality of bundled conducting wires being wound such that the flattened cross section lie along an axial line of the coiled conducting wire means.

According to the above-described method of manufacturing a chip inductor, a plurality of chip inductor main bodies are manufactured at the same time by following the steps of: forming a winding core by extruding a kneaded material to be obtained by kneading a powdered magnetic material and a binder; winding conducting wire means around the winding core in a coiled manner, a distance between adjoining winds being smaller than about twice the diameter of the conducting wire means; forming the external cover element to enclose the winding core around which the conducting wire has been wound, the external cover element being formed by extruding the kneaded material; sintering the winding core and the external cover member; and cutting a semimanufactured product obtained by the preceding steps into a predetermined length to thereby obtain a plurality of chip inductor main bodies. On both end surfaces of the respective chip inductor main bodies, there are formed external electrodes.

The chip inductor according to another aspect of the present invention has both end portions of the arcuate or similar shape of conducting wire means which are exposed to both end surfaces of each of the chip inductor main bodies. Therefore, the external electrodes formed on both end surfaces of the inductor main bodies are connected to the arcuate or similar shape of the conducting wire means. According to this arrangement, since the areas of connection between the external electrodes and the end portions of the conducting wire means become large, there will be no possibility of the connecting portions' being broken, before the conducting wire means is broken, when a pulsed electric current is caused to flow through the inductor. According to a preferred embodiment as described above, if the coiled conducting wire means is made up of one or a plurality of bundled conducting wires whose cross section or an overall cross section in the case of the plurality of bundled conducting wires is flattened, and the one or a plurality of bundled conducting wires are wound such that the flattened cross section lies along an axial line of the coiled conducting wire means, the distance between the adjoining winds becomes smaller than the one with a single conducting wire of round or square cross section, provided the magnetic core and the number of winding remain the same. Therefore, both the end portions, of arcuate or similar shape, of the conducting wire means have larger lengths and, as a consequence, still larger areas of connection to the external electrodes can be secured. According to still another preferred embodiment of the present invention in which the coiled conducting wire means is formed by a plurality of conducting wires which are bundled together, even if there occurs breaking at the connection between the external electrode and one of the conducting wires when the pulse electric current is caused to flow through the coiled conducting wires, there will still remain other connections between the remaining end portions of the conducting wires and the external electrodes, thereby securing a high safety.

BRIEF DESCRIPTION OF THE DRAWINGS

The above and other objects and the attendant advantages of the present invention will become readily apparent by reference to the following detailed description when considered in conjunction with the accompanied drawings wherein.

DETAILED DESCRIPTION OF PREFERRED EMBODIMENTS

An explanation will now be made about embodying examples of the present invention with reference to the accompanying drawings.

Figure 1A:
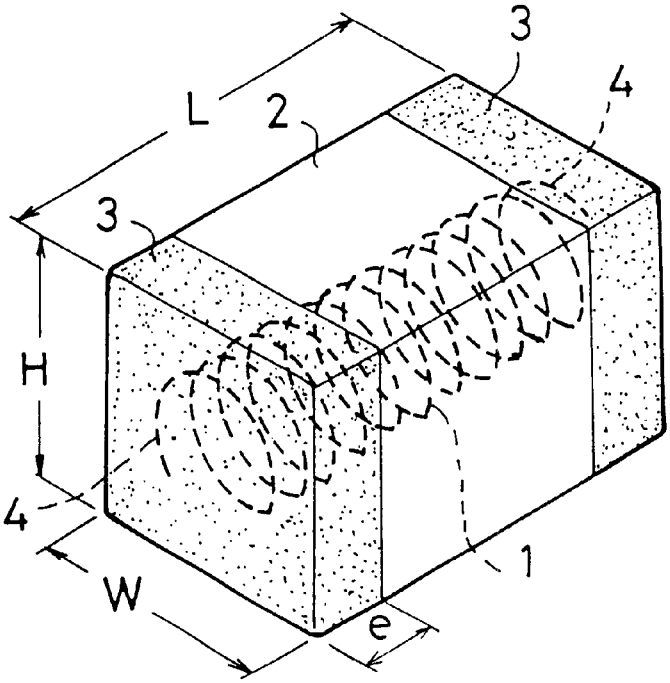
FIGS. 1A and 1B are a perspective view and a front view, partly shown in section, of one example of the chip inductor according to the present invention.
Figure 1B:
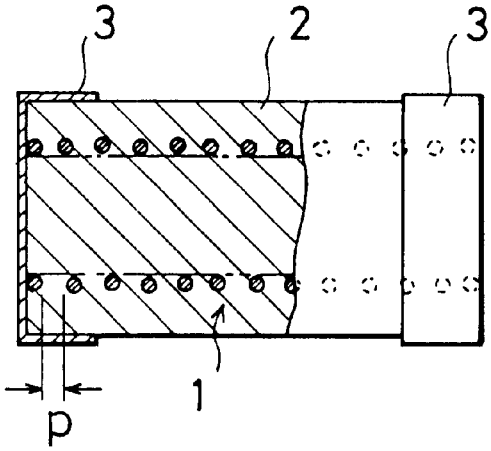
Figure 1C:
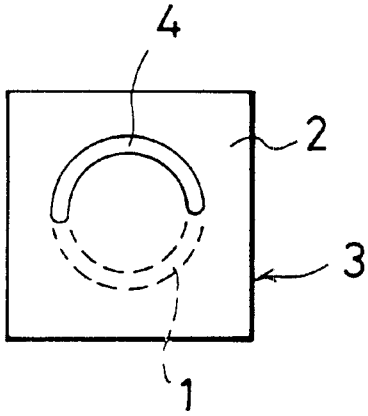
FIG. 1C is a side view of the chip inductor main body thereof.

FIGS. 1A through 1C represent one embodying example of the chip inductor according to the present invention.

In these Figures, reference numeral 1 denotes a conductor wound in a coiled manner (or a coiled conducting wire) which was formed by winding a conducting wire made of a silver wire of 20–100 $\mu$m in diameter while making a distance p between the adjoining winds of the conducting wire 1 smaller than about twice the diameter of the conducting wire. Reference numeral 2 denotes a magnetic member of a rectangular parallelepiped in which was embedded the coiled conducting wire 1 and which was made of ferrite (e.g., L=1.0–10.0 mm, W=0.5–10.0 mm, H=0.5–10.0 mm). Reference numerals 3, 3 denote external electrodes which were made by coating both end surfaces and adjoining external peripheral end portions (e=0–4.0 mm) of the magnetic member 2. The external electrodes 3, 3 were connected to those arcuate or similar shape of both end portions 4, 4 of the coiled conducting wire 1 which were exposed to both the end surfaces of the magnetic member 2. These external electrodes 3, 3 were made, for example, of silver electrodes and were subjected to nickel plating or lead-tin plating on top thereof.

The above-described magnetic member 2 was made up of an internal magnetic element which serves as a winding core around which the coiled conducting wire 1 is wound and a magnetic element which serves as an external cover element to cover or coat the coiled conducting wire 1. The internal magnetic element was made up of a ferrite whose composition is iron, nickel, zinc, copper or the like. This ferrite was manufactured by forming a kneaded material of columnar shape with a kneaded material of a powdered magnetic material (or raw meal of a magnetic material) of 0.7 $\mu$m in particle size and a binder of glycerine-methyl cellulose, both being mixed in the ratio of 100:8, and thereafter sintering the kneaded material. After sintering, it had a permeability of 100, and a shrinkage percentage at the time of sintering was 23%, for example. This shrinkage at the time of sintering is also called a firing shrinkage and the shrinkage percentage is represented by the formula $\{(l_0-l_1)/l_0\}\times 100$, where $l_0$ is the length of the formed semimanufactured product before sintering and $l_1$ is the length after sintering it. The magnetic element which serves as the external cover element was made up of the powdered magnetic material of the same composition and particle size as those of the above-described internal magnetic element, and the same binder. To make the external cover element, the kneaded material having the powdered magnetic material and the binder in a mixing ratio of 100:6 was sintered. The shrinkage percentage thereof at the time of sintering was 20%, for example. With these shrinkage percentages, the parallelepiped (i.e., the external cover element) of 4.0 mm in height (H) and also 4.0 mm in width (W) became, after sintering, both 3.2 mm. The winding core, on the other hand, of 2.6 mm in diameter inside the coiled conducting wire 1 became 2.0 mm after sintering. The internal diameter of the external cover element became 2.08 mm after sintering. It follows that a clearance of 0.08 mm was formed between the internal diameter of the external cover element in which the coiled conducting wire 1 was contained and the external diameter of the magnetic element as the winding core.

According to the arrangement of the above-described inductor, when a pulse energy of 8 Jule (J), for example, was caused to flow through the coiled conducting wire 1 of 2.08 mm in coil diameter, there was breaking neither in the coiled conducting wire 1 nor in the connecting portions between the arcuate end portions of the coiled conducting wire and the external electrodes 3. On the other hand, in a comparative inductor using a conducting wire which had the same cross-sectional area and in which the front ends of the end portions were connected to the external electrodes, breaking occurred at the connecting portions when the same pulse electric current was caused to flow therethrough.

Next, an explanation will now be made about the method of manufacturing the chip inductor of the present invention as shown in FIGS. 1A–1C.

Figure 2:
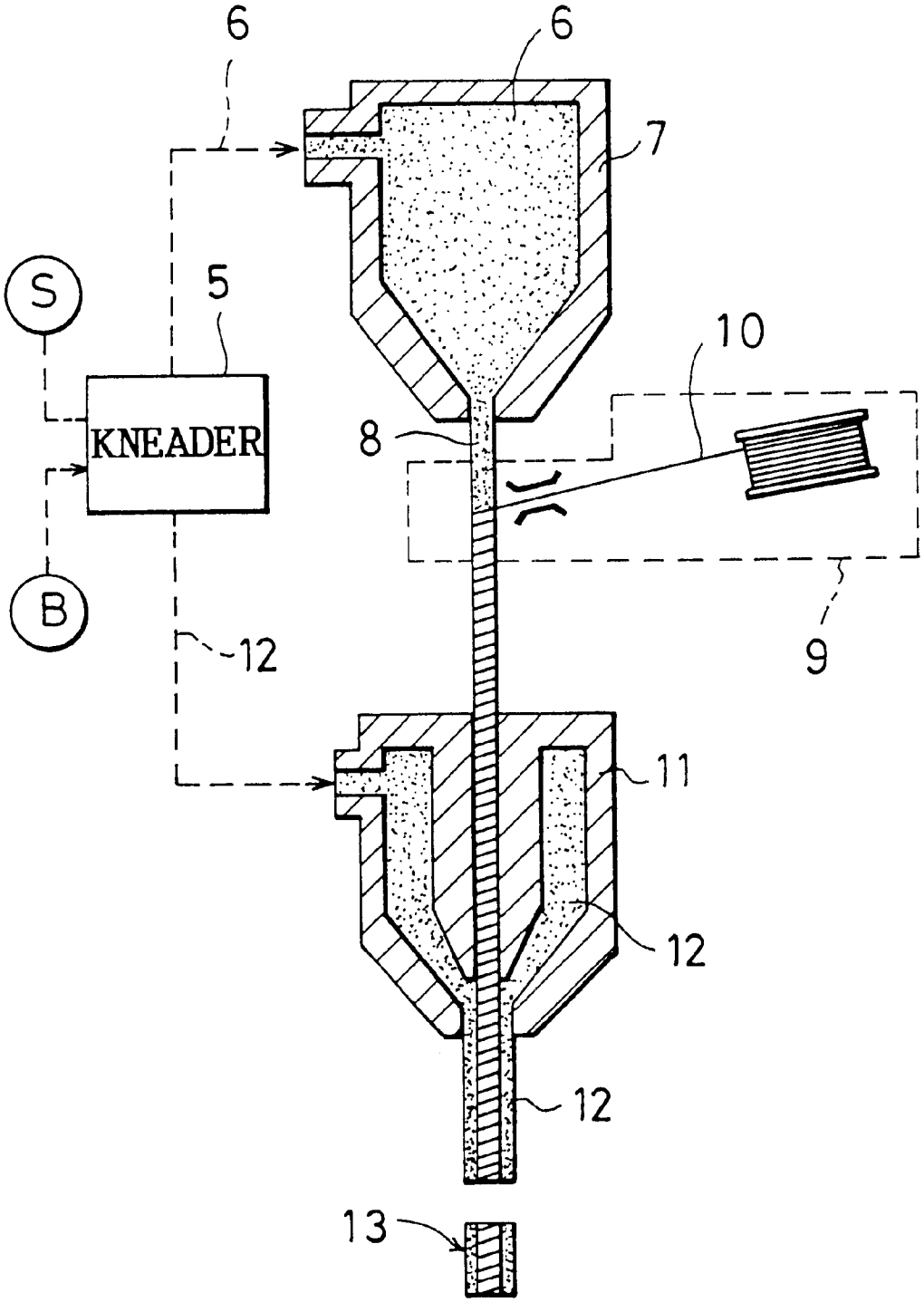
FIG. 2 is a diagram showing an apparatus which is to be used in carrying out the method of manufacturing the chip inductor of the present invention.

As shown in FIG. 2, a binder S and a powdered magnetic material B of the above-described mixing ratio were kneaded by a kneader 5 to homogenize the powdered magnetic material and the binder. The kneaded material 6 was fed under pressure to a primary extruder 7. A molded bar-like body 8, serving as a winding core, which was molded to a desired diameter of 0.5–10 mm, for example, was extruded out of an outlet of the primary extruder 7 at a speed of 30 m/min, for example. This bar-like body 8 was dried in a dryer (not illustrated). Thereafter, a conducting wire 10 was wound by a winding device 9 around the bar-like body 8 such that the distance p between the adjoining winds of the conducting wire 10 became smaller than about twice the diameter of the conducting wire. The bar-like body 8 having wound therearound the conducting wire 10 was fed to a secondary extruder 11. To this secondary extruder 11 there was fed in advance under pressure a kneaded material 12 which was made by making larger the mixing ratio of the powdered magnetic material and the binder, with a consequent smaller shrinkage percentage than the kneaded material 6 that was fed under pressure to the primary extruder 7. Therefore, by this secondary extruder 11 the conducting wire 10 wound around the bar-like body 8 was covered or coated by the kneaded material 12, thereby forming an external cover (or coating) element. Thereafter, the semi-manufactured product was cut into a size to suit the size of a sintering furnace or the shape of a setting device on which the semimanufactured product is placed for sintering in the sintering furnace. The semimanufactured product was then sintered at 600–1000° C., in particular at 900° C., and was cut by a cutting device to suit the dimensions of respective inductors. The individual cut inductor main bodies 13 were then subjected to barrel polishing using a barreling powder and water and were rounded at corner portions thereof. Thereafter, a silver paste was coated on both external surface portions of each inductor main body 13 and their adjoining peripheral external portions, and was baked to thereby form external electrodes 3, 3. At this time, exposed end portions 4, 4 of a circular or similar shape of the conducting wire 10 and the external electrodes 3 were connected to each other. To the silver layer of each external electrode 3 there was applied a nickel plating and a solder plating.

In this embodying example, the shrinkage percentage, at the time of sintering, of the magnetic element inside the coiled conducting wire 1 was made larger than the shrinkage percentage of the magnetic element in the form of the external cover element. Therefore, the stress of the magnetic member as the external cover element due to shrinkage thereof at the time of sintering is not exerted on the magnetic element inside the coiled conducting wire 1 via the coiled conducting wire 1 and/or the clearance between the adjoining winds of the coiled conducting wire 1. The impedance characteristics of the inductor will therefore be not deteriorated.

However, if the shrinkage percentages of the winding core and the external cover element are made the same by making equal the mixing ratios of the powdered magnetic material and the binder, the stress due to shrinkage of the external cover element at the time of sintering is neither imposed on the winding core. Furthermore, since there occurs no clearance between the coiled conducting wire 1 and the winding core, the impedance characteristics are further improved.

The particle size of the powdered magnetic material of the above-described core member may be made to be 0.7 $\mu$m, for example, and the particle size of the powdered magnetic material of the external cover element may be made, for example, to be coarser than 0.7 $\mu$m or equal thereto, with the remaining conditions being the same. It may thus be arranged that the shrinkage percentage of the winding core at the time of sintering becomes larger than the shrinkage percentage of the external cover element or equal thereto.

Figure 3A:
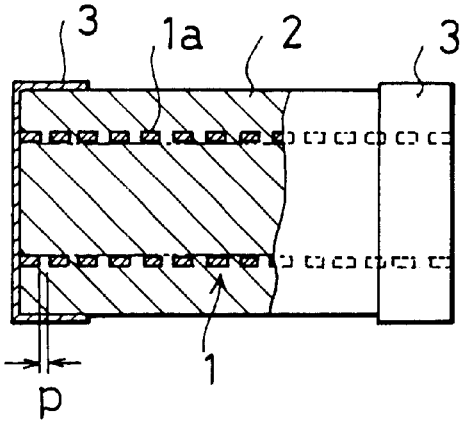
FIG. 3A is a front view, partly shown in section, of a second embodying e the chip inductor of the present invention
Figure 3B:
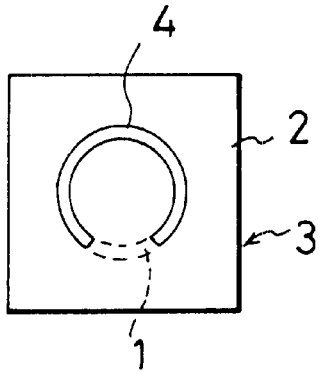
FIG. 3B is a side view of the chip inductor main body thereof.
Figure 4:
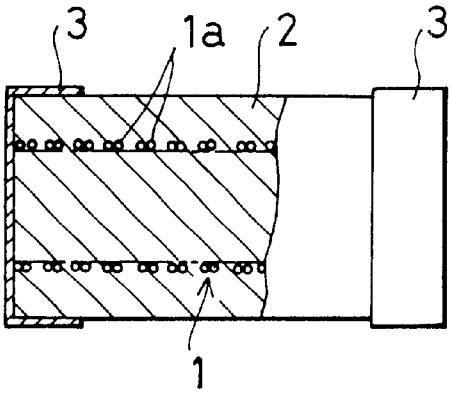
FIG. 4 is a front view, partly shown in section, of a third embodying example of the chip inductor of the present invention.

The conducting wire may be made, as shown in FIGS. 3A and 3B, into the shape of a coil by winding a conducting wire la of flattened cross section such that its flattened surface lies along an axial direction of the coiled conducting wire 1. In such an arrangement, as compared with an example in which a conducting wire of circular or square cross-sectional area, for example, is used with a magnetic member 2 of the same length and of the same winding number of the coiled conducting wire 1, the distance between the adjoining winds becomes smaller. Therefore, those both end portions of the coiled conducting wire 1 which are exposed to both end surfaces of the magnetic member 2 become longer, with the result that the areas of contact with the external electrodes become larger. The areas of contact also become larger if, as shown in FIG. 4, a plurality of, e.g. two, conducting wires 1*a,* 1*a* of circular cross sectional area which are bound into an overall oblong cross-sectional shape are used such that the flattened surface thereof lies along the axial direction of the coe conducting wire 1.

Figure 5:
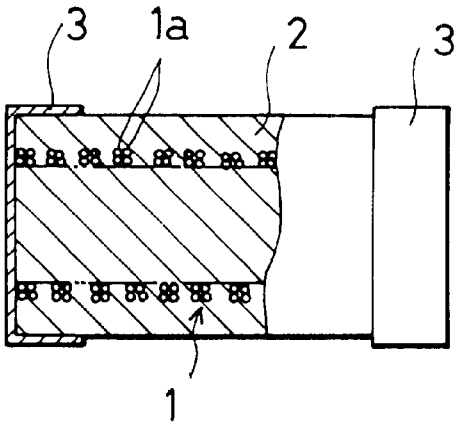
FIG. 5 is a front view, partly shown in section, of a fourth embodying example of the chip inductor of the present invention.

Further, as shown in FIG. 5, if a plurality of, e.g. four, conducting wires 1*a*—1*a* are wound together into a coiled shape to connect both end portions thereof to external electrodes 3, 3, two conducting wires 1*a*, 1*a,* for example, out of the plurality of conducting wires 1*a*—1*a*, which are exposed in a circular shape to the end surfaces of the magnetic member 2, are connected to the external electrodes 3. According to this arrangement, when the pulse electric current is caused to flow through the inductor, there is little or no possibility of two conducting wires' being cut or broken at the same time. It follows that this arrangement is superior to the one shown in FIG. 1 in point of safety.

According to the arrangement of one aspect of the present invention, since the connecting areas between the. external electrodes and the conducting wire means are large, there is an effect in that, when a pulse electric current is caused to flow through the inductor, the connecting portions are hardly likely to be broken before the conducting wire means itself is broken. According to another aspect of the present invention, there is a further effect in that the conducting wires are less likely to be broken. According to still another aspect of the present invention, there is a further effect in that, when a large pulse electric current is caused to flow through the inductor, the conducting wire or wires are less likely to be broken at the connecting portions between the end portions of the conducting wire or wires and the external electrodes. Still another effect can be attained in that there is obtained an inductor which is suitable for mass production.

It is readily apparent that the above-described inductor and the method of manufacturing the same meet all of the objects mentioned above and also have the advantages of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A chip inductor comprising:

coiled conducting wire;

a magnetic core which is formed by sintering and in which said coiled conducting wire is embedded, said magnetic core including at least a first exterior end surface and a second exterior end surface, wherein first and second end portions of said coiled conducting wire are respectively exposed from said first and second exterior end surfaces of said magnetic core in an arcuate shape, and said first and second end portions of said coiled conducting wire are respectively flush with said first and second exterior end surfaces of said magnetic core to respectively form first and second smooth continuous surfaces; and external electrodes coated on said first and second smooth continuous surfaces and connected to said first and second end portions of said coiled conducting wire.

2. A chip inductor according to claim 1, wherein said coiled conducting wire one or a plurality of bundled conducting wires, said one or a plurality of bundled conducting wires having a flattened cross section or an overall flattened cross section in case of said plurality of conducting wires, said flattened cross section being arranged to lie along an axial line of said coiled conducting wire.

3. A chip inductor according to claim 1, wherein said coiled conducting wire is made up of a plurality of conducting wires which are bundled together.

4. The chip inductor of claim 1, wherein said coiled conducting wire is wound about an axis extending in a first direction and said first and second exterior surfaces of said magnetic core are substantially perpendicular to said first direction.

5. The chip inductor of claim 1, wherein said first and second portions of said coiled conducting wire forming arcuate shapes lie in planes substantially perpendicular to an axis about which said coiled conducting wire is wound.

6. The chip inductor of claim 1, wherein said first and second exterior surfaces of said magnetic core are substantially planar.

7. The chip inductor of claim 1, wherein said first and second end portions of said coiled conducting wire respectively exposed from said first and second exterior end surfaces of said magnetic core in an arcuate shape are flat surfaces.

8. The chip inductor of claim 1, wherein said first and second smooth continuous surfaces are substantially planar.

* * * * *